US006061534A

United States Patent [19]

Okada et al.

[11] Patent Number: 6,061,534

[45] Date of Patent: May 9, 2000

[54] TWO-COLOR IMAGE FORMING APPARATUS THAT PREVENTS FRINGE DEVELOPMENT

[75] Inventors: Hisao Okada; Teruaki Mitsuya; Shinichi Akatsu, all of Ibaraki, Japan

[73] Assignee: Hitachi Koki Co., Ltd., Tokyo, Japan

[21] Appl. No.: 09/158,516

[22] Filed: Sep. 22, 1998

[30] Foreign Application Priority Data

Sep. 26, 1997 [JP] Japan ..... 9-261982

[51] Int. Cl.[7] ..... G03G 15/02

[52] U.S. Cl. ..... 399/51; 399/55

[58] Field of Search ..... 399/51, 53, 55

[56] References Cited

U.S. PATENT DOCUMENTS

| | | | |
|---|---|---|---|
| 4,078,929 | 3/1978 | Gundlach | 430/42 |
| 5,751,437 | 5/1998 | Parker et al. | 399/184 |
| 5,835,819 | 11/1998 | Yamamoto | 399/51 |
| 5,884,119 | 3/1999 | Maruo et al. | 399/51 |

FOREIGN PATENT DOCUMENTS 1-189664 7/1989 Japan .

*Primary Examiner*—Fred L. Braun

*Attorney, Agent, or Firm*—Sughrue, Mion, Zinn, Macpeak & Seas, PLLC

[57] ABSTRACT

In a two-color image forming apparatus, correction exposure of creating an area having a potential between an image area potential and a white area potential is made for a decided white area on the periphery of the image area. A potential difference between the image area and white area is reduced to attenuate an edge effect, thereby preventing the fringe development. This is accomplished by varying the light amount for the white areas of the intermediate potential areas as a function of the following: surface potentials measured, change in the developing bias voltage and rotating speed of a developing roll, adjustment of the amount of toners by a toner sensor, changing the resistance of a developer, and/or development of raster image processing.

9 Claims, 8 Drawing Sheets

DISTRIBUTION OF SURFACE POTENTIAL

DISTRIBUTION OF SURFACE ELECTRIC FIELD
AND FRINGE DEVELOPMENT

DISTRIBUTION OF SURFACE POTENTIAL

DISTRIBUTION OF SURFACE POTENTIAL

FIG. 5A

| | i-8 | i-7 | i-6 | i-5 | i-4 | i-3 | i-2 | i-1 | i | i+1 | i+2 | i+3 | i+4 | i+5 | i+6 | i+7 | i+8 |
|---|---|---|---|---|---|---|---|---|---|---|---|---|---|---|---|---|---|
| j-8 | 0 | 0 | 0 | 0 | 0 | 0 | 0 | 0 | 0 | 0 | 0 | 0 | 0 | 0 | 0 | 0 | 0 |
| j-7 | 0 | 0 | 0 | 0 | 0 | 0 | 0 | 0 | 0 | 0 | 0 | 0 | 0 | 0 | 0 | 0 | 0 |
| j-6 | 0 | 0 | 0 | 0 | 0 | 0 | 0 | 0 | 0 | 0 | 0 | 0 | 0 | 0 | 0 | 0 | 0 |
| j-5 | 0 | 0 | 0 | 0 | 0 | 0 | 0 | 0 | 0 | 0 | 0 | 0 | 0 | 0 | 0 | 0 | 0 |
| j-4 | 0 | 0 | 0 | 0 | 0 | 0 | 0 | 0 | 0 | 0 | 0 | 0 | 0 | 0 | 0 | 0 | 0 |
| j-3 | 0 | 0 | 0 | 0 | 0 | 0 | 0 | 0 | 0 | 0 | 0 | 0 | 0 | 0 | 0 | 0 | 0 |
| j-2 | 0 | 0 | 0 | 0 | 0 | 0 | 0 | 0 | 0 | 0 | 0 | 0 | 0 | 0 | 0 | 0 | 0 |
| j-1 | 0 | 0 | 0 | 0 | 0 | 0 | 0 | 0 | 0 | 0 | 0 | 0 | 0 | 0 | 0 | 0 | 0 |
| j | 0 | 0 | 0 | 0 | 0 | 0 | 0 | 0 | 0 | 0 | 0 | 0 | 0 | 0 | 0 | 0 | 0 |
| j+1 | 0 | 0 | 0 | 0 | 0 | 0 | 0 | 0 | 0 | 0 | 0 | 0 | 0 | 0 | 0 | 0 | 0 |
| j+2 | 0 | 0 | 0 | 0 | 0 | 0 | 0 | 0 | 0 | 0 | 0 | 0 | 0 | 0 | 0 | 0 | 1 |
| j+3 | 0 | 0 | 0 | 0 | 0 | 0 | 0 | 0 | 0 | 0 | 0 | 0 | 0 | 0 | 0 | 1 | 1 |
| j+4 | 0 | 0 | 0 | 0 | 0 | 0 | 0 | 0 | 0 | 0 | 0 | 0 | 0 | 0 | 0 | 1 | 1 |
| j+5 | 0 | 0 | 0 | 0 | 0 | 0 | 0 | 0 | 0 | 0 | 0 | 0 | 0 | 0 | 1 | 1 | 0 |
| j+6 | 0 | 0 | 0 | 0 | 0 | 0 | 0 | 0 | 0 | 0 | 0 | 0 | 0 | 1 | 1 | 0 | 0 |
| j+7 | 0 | 0 | 0 | 0 | 0 | 0 | 0 | 0 | 0 | 0 | 0 | 0 | 1 | 1 | 0 | 0 | 0 |

CONTENTS OF IMEGE MEMORY
OF CHARGING POTENTIAL AREA

FIG. 5B

| | i-8 | i-7 | i-6 | i-5 | i-4 | i-3 | i-2 | i-1 | i | i+1 | i+2 | i+3 | i+4 | i+5 | i+6 | i+7 | i+8 |
|---|---|---|---|---|---|---|---|---|---|---|---|---|---|---|---|---|---|
| j-8 | 1 | 1 | 1 | 1 | 1 | 1 | 1 | 1 | 1 | 1 | 1 | 1 | 1 | 1 | 1 | 1 | 1 |
| j-7 | 1 | 1 | 1 | 1 | 1 | 1 | 1 | 1 | 1 | 1 | 1 | 1 | 1 | 1 | 1 | 1 | 1 |
| j-6 | 1 | 1 | 1 | 1 | 1 | 1 | 1 | 1 | 1 | 1 | 1 | 1 | 1 | 1 | 0 | 0 | 0 |
| j-5 | 1 | 1 | 1 | 1 | 1 | 1 | 1 | 1 | 1 | 1 | 1 | 1 | 0 | 0 | 0 | 0 | 0 |
| j-4 | 1 | 1 | 1 | 1 | 1 | 1 | 1 | 1 | 1 | 1 | 1 | 0 | 0 | 0 | 0 | 0 | 0 |
| j-3 | 1 | 1 | 1 | 1 | 1 | 1 | 1 | 1 | 1 | 1 | 0 | 0 | 0 | 0 | 0 | 0 | 0 |
| j-2 | 1 | 1 | 1 | 1 | 1 | 1 | 0 | 0 | 0 | 0 | 0 | 0 | 0 | 0 | 0 | 0 | 0 |
| j-1 | 1 | 1 | 0 | 0 | 0 | 0 | 0 | 0 | 0 | 0 | 0 | 0 | 0 | 0 | 0 | 0 | 0 |
| j | 0 | 0 | 0 | 0 | 0 | 0 | 0 | 0 | 0 | 0 | 0 | 0 | 0 | 0 | 0 | 0 | 0 |
| j+1 | 0 | 0 | 0 | 0 | 0 | 0 | 0 | 0 | 0 | 0 | 0 | 0 | 0 | 0 | 0 | 0 | 0 |
| j+2 | 0 | 0 | 0 | 0 | 0 | 0 | 0 | 0 | 0 | 0 | 0 | 0 | 0 | 0 | 0 | 0 | 0 |
| j+3 | 0 | 0 | 0 | 0 | 0 | 0 | 0 | 0 | 0 | 0 | 0 | 0 | 0 | 0 | 0 | 0 | 0 |
| j+4 | 0 | 0 | 0 | 0 | 0 | 0 | 0 | 0 | 0 | 0 | 0 | 0 | 0 | 0 | 0 | 0 | 0 |
| j+5 | 0 | 0 | 0 | 0 | 0 | 0 | 0 | 0 | 0 | 0 | 0 | 0 | 0 | 0 | 0 | 0 | 0 |
| j+6 | 0 | 0 | 0 | 0 | 0 | 0 | 0 | 0 | 0 | 0 | 0 | 0 | 0 | 0 | 0 | 0 | 0 |
| j+7 | 0 | 0 | 0 | 0 | 0 | 0 | 0 | 0 | 0 | 0 | 0 | 0 | 0 | 0 | 0 | 0 | 0 |

CONTENTS OF IMEGE MEMORY OF
DISCHARGING POTENTIAL AREA

TWO-COLOR IMAGE FORMING APPARATUS THAT PREVENTS FRINGE DEVELOPMENT

BACKGROUND OF THE INVENTION

1. Field of the Invention

The present invention relates to a two-color image forming apparatus using electrophotography.

First, it should be noted that the two-color image forming apparatus referred to by the invention includes not only a case using two kinds of toners with different colors, but also a case using toners having the same color but different properties. For example, the present invention can be applied to the case where with the same black color, the one toner is non-magnetic whereas the other toner is magnetic, namely, application of magnetic information to a part of the image is intended.

2. Description of the Related Art

A two-color image forming apparatus has been proposed in which after a photosensitive body has been charged, electrostatic latent images with three levels are formed on a photosensitive body by changing light exposure in three levels of no exposure, weak exposure and strong exposure in accordance with color information and they are developed using positive-charged toners and negative charged toners to form a two-color toner image on the photosensitive body.

Such a two-color image forming apparatus gives rise to fringe development in which a periphery of the image with one color is fringed with another color so that a clear image cannot be obtained.

The mechanism of this fringe development can be elucidated as follows.

FIGS. 2A and 2B are graphs for explaining the fringe development in which the distribution of the electric potential and electric field are shown with respect to positions on the surface of a photosensitive body after exposure.

As shown in FIG. 2A, the surface potential after exposure of the photosensitive body in the two-color image forming apparatus includes a charging potential Vca at a no exposure area, an intermediate potential Vw at a weak exposure area and a discharging potential Vda at a strong exposure area. At the area charged with the charging potential of Vca, first toners are developed in a normal development by a developing machine with a developing bias voltage Vb1 applied. On the other hand, at the area charged with the discharging potential of Vda, the second toners are developed in an inverted development by the developing machine with a developing bias voltage Vb2 applied. At the area charged with the intermediate potential of Vw, no toners are developed, thus providing a white area. However, as seen from FIG. 2B showing the surface electric field on the photosensitive body, the area with the intermediate potential Vw provides inverted electric fields due to the edge effect in the vicinities of the areas with the potentials of Vca and Vda because there are large differences between Vw and Vca, and between Vw and Vda. Toners with the opposite charging polarities are applied to the areas with the opposite electric fields. Therefore, assuming that the first toner is black and the second toner is red, the white areas on the periphery of the black image is developed in red and the white area on the periphery of the red image is developed in black. This is referred to as "fringe" development because the periphery of the black image appears as if it is fringed with red, and the periphery of the red image is fringed with black. Such color printing, which should not be essentially formed, makes the image unclear and leads to the result of recording erroneous information as erroneous printing. This problem must be solved.

The fringe development has a property that it is conspicuous as the development bias voltages Vb1 and Vb2 is close to the intermediate potential Vw of the area with weak exposure, and not conspicuous as the former is far from the latter. Therefore, using this property, in order to reduce the fringe development, it can be proposed to leave the developing bias voltages Vb1 and Vb2 from Vw. However, this reduces a difference between the developing bias voltages and the potentials of the image area with the toners applied, i.e. Vca−Vb1 and Vda−Vb2. As a result, the amount of toners developed in the inherent image areas is reduced to attenuate the image density. Namely, the fringe development can be reduced, but the inherent development itself will be attenuated. Accordingly, such. a proposal cannot solve the problem of the fringe development.

As another means for solving the fringe development, a technique of using a developer with low resistance has been proposed in JP-A-1-189664. This technique uses the development agent with low resistance to attenuate the edge effect so that the electric field on the periphery becomes low. However, the developer with too low resistance gave rise to a secondary problem that carriers are applied on the photosensitive body. The carriers applied on the photosensitive body provide a gap between a toner image on the photosensitive body and a sheet of paper in transfer. This reduces the strength of the electric field in transfer thereby to lead to poor copying of the toner image. In this case, a part of the character or image drops off with being transferred on the sheet of paper. Accordingly, it is difficult to use the second means of using the developer with low resistance in order to solve the fringe development.

Even when the developing bias voltage is combined with the resistance of the developer under the condition solving the fringe problem, the following problem occurs.

Since the property of the photosensitive body will change with elapse of time by use and the discharging wire of a charger will deteriorate, the intermediate potential changes inevitably. When the intermediate potential changes so that its difference from the developing bias voltage becomes small, the fringe development occurs.

The resistance of the developer changes with an environmental change, a change in a toner density, and a time-varying change of a carrier surface, etc. When the resistance of the developer changes so as to become high, e.g. the environment is placed in a low humidity atmosphere or the toner density becomes high, the fringe development will also occur.

Further, when the rotating speed of the developing roll of the developing machine is changed, the force of the developer rubbing the surface of the photosensitive body changes. This influences the fringe development.

As described above, the fringe development, which is affected by various causes, is difficult to solve by the prior art.

SUMMARY OF THE INVENTION

The present invention has been accomplished in order to solve the above problem, and intends to provide a two-color image forming apparatus which can prevent a fringe development and provide a clear image.

The above problem can be solved in light exposure after having charged the photosensitive body, by making exposure with three levels of light amounts providing a charging potential area where toners are developed in a normal development, a discharging potential area where the toners are developed in an inverted fashion and an intermediate potential area where no toner is developed, and also deciding the white areas on the periphery of the potential areas where the toners are developed to make exposure with a light amount of light providing a potential between the potentials where the toners are developed and the intermediate potential, more specifically providing a means for exposing the white area on the periphery of the charging potential area to the amount of light providing a potential between the charging potential and the intermediate potential and that on the periphery of the discharging potential area with the amount of light providing a potential between the discharging potential and the intermediate potential.

The above problem can be surely solved, in addition to providing the above means, by adjusting the light amount so that the intermediate potential is a prescribed value on the basis of the value detected by a surface potential meter, and adjusting the light amount for exposure for the area on the periphery of the potential areas where the toners are developed, in accordance with a developing bias voltage and a rotating speed of a developing roll or an electric resistance of a developer measured by a measuring means.

The above problem can be further surely solved by adjusting the light amount of exposure for the area on the periphery of the areas where the toners are developed so that application of the toners due to a fringe development is not detected by a sensor for detecting the amount of applied toners.

The above problem can be solved by providing a processor for developing an image into dots to decide the area to be exposed with the amount of light providing a potential between a toner developing potential and an intermediate potential at the area on the potential areas where the toners are developed, and on the basis of the decision result, by making exposure with the light amount adjusted on the periphery of the potential areas where the toners are developed.

BRIEF DESCRIPTION OF THE DRAWINGS

A

FIGS. 5A and 5B are views for explaining correction exposure;

DETAILED DESCRIPTION OF THE PREFERRED EMBODIMENTS

Now, a description will be given in more detail of preferred embodiments of the invention with reference to the accompanying drawings.

Embodiment 1

Figure 1:
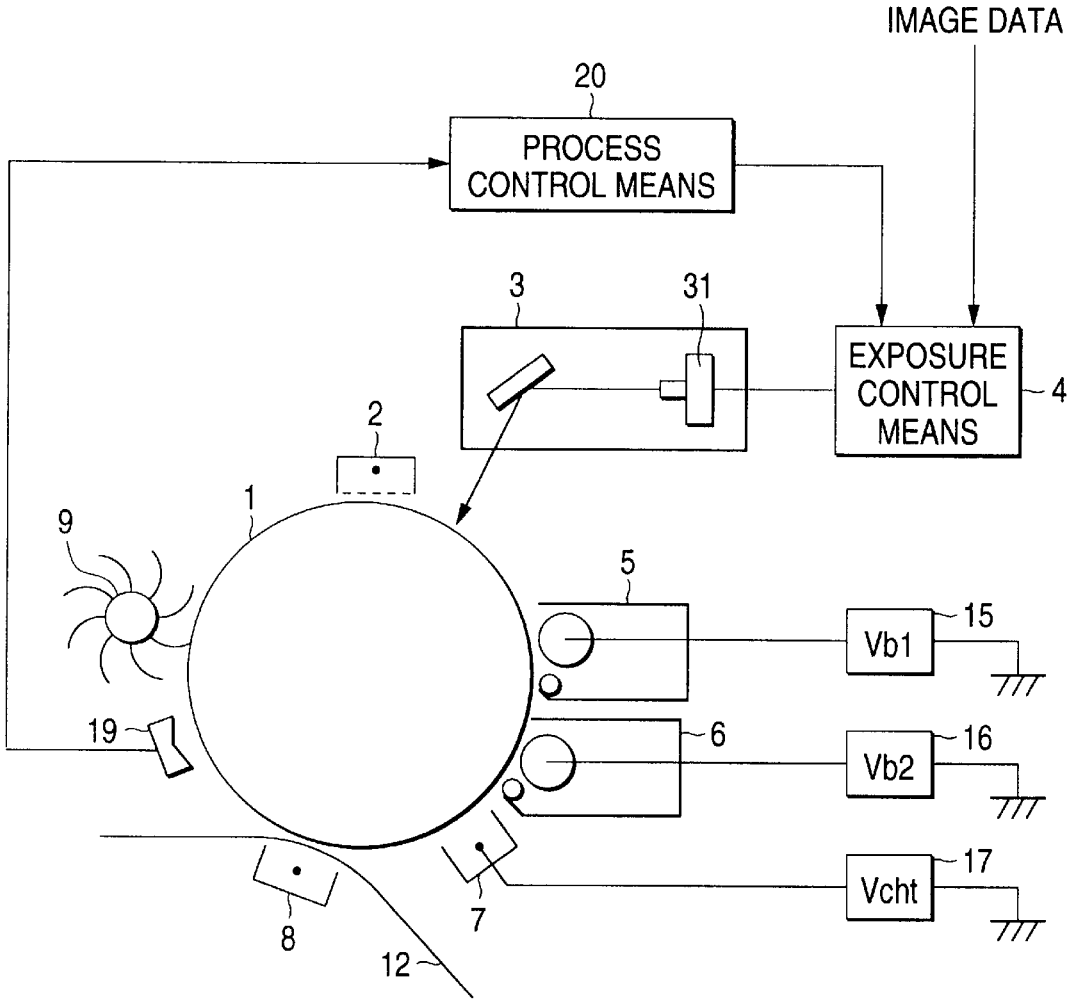
FIG. 1 is a schematic diagram of a two-color image forming apparatus according to the present invention.
Figure 2A:
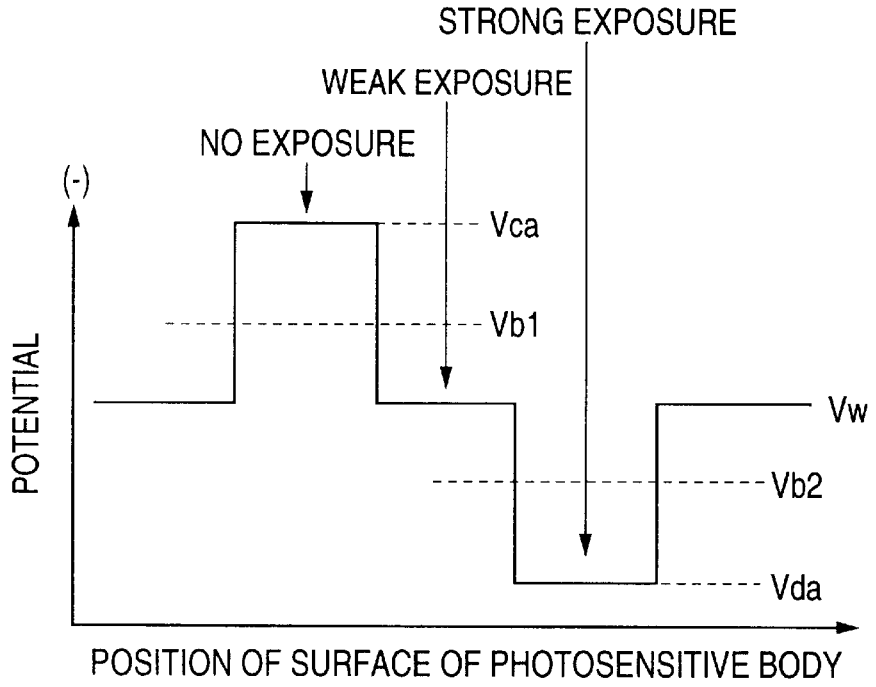
FIGS. 2A and 2B are graphs for explaining a fringe development.
Figure 2B:
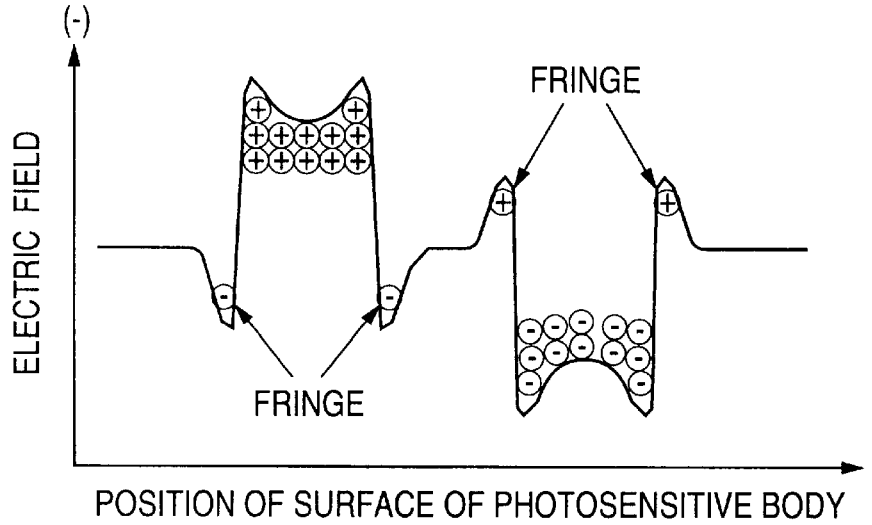
Figure 3A:
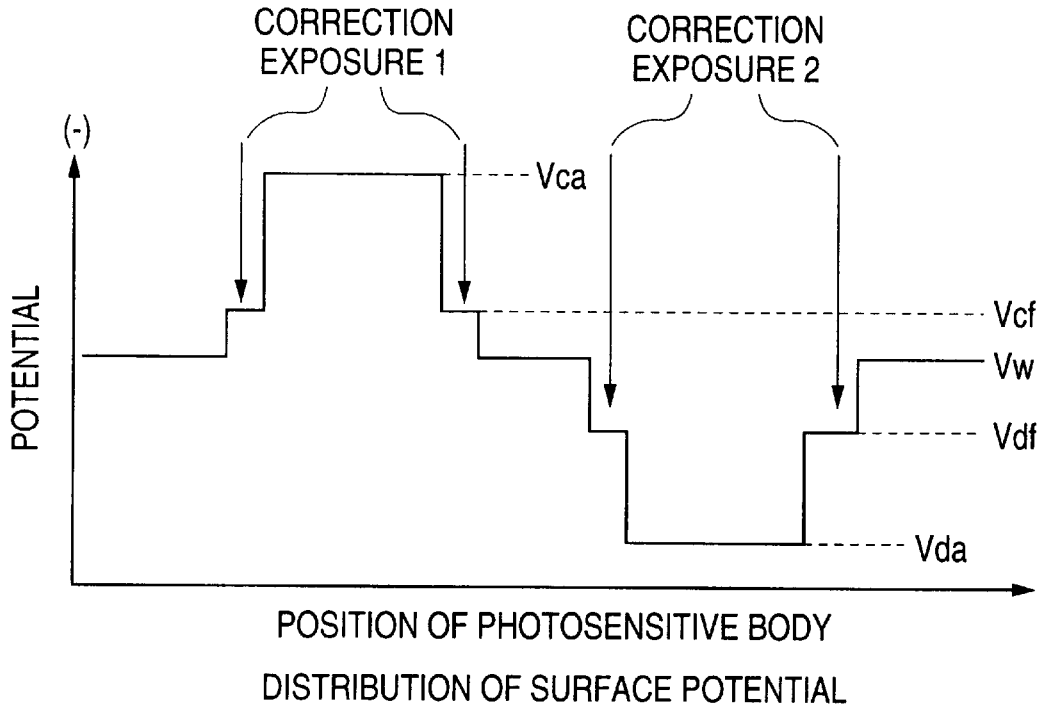
FIGS. 3A and 3B are graphs for explaining suppression of a fringe due to correction exposure.
Figure 3B:
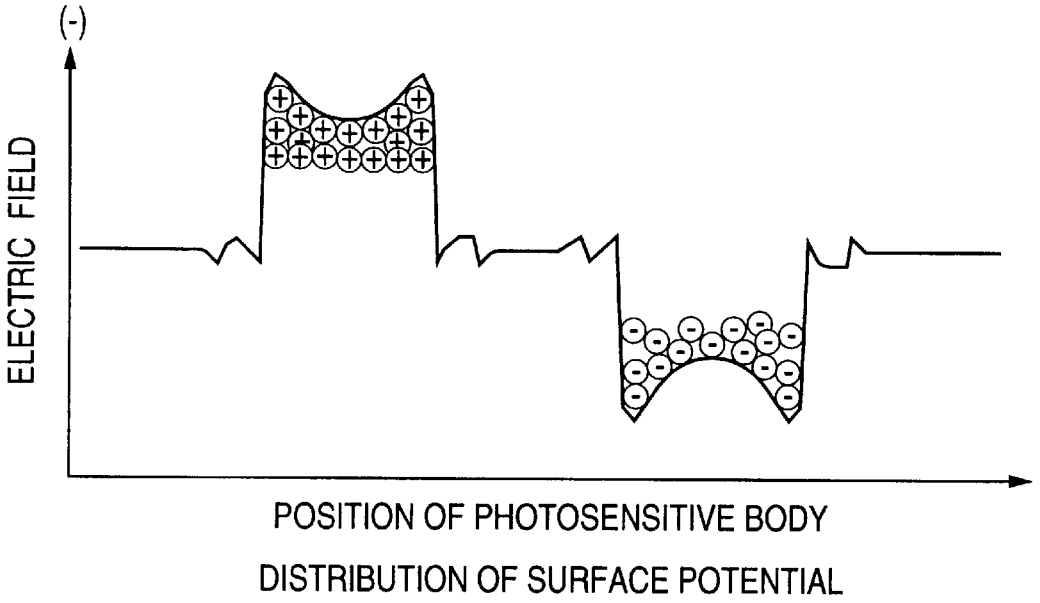

Now referring to FIGS. 1 to 3B, an explanation will be given of the first embodiment of the present invention. FIG. 1 is a schematic diagram of a two-color image forming apparatus according to the present invention. FIGS. 2A and 2B are graphs for explaining a fringe development. FIGS. 3A and 3B are graphs for explaining the fringe suppression by correction exposure.

FIG. 1 shows in a schematic configuration the first embodiment of the two-color image forming apparatus to which the present invention is applied. In FIG. 1, reference numeral 1 denotes a photosensitive body; 2 a first charger; 3 an exposure; 4 an exposure control means; 5 a first developing unit; 6 a second developing unit; 7 a second charger; 8 a transfer, 9 a cleaner; 12 a recording medium; 15, 16, 17 a power source; 19 a sensor for detecting the amount of applied toners; 20 a process control means; and 31 a laser. Now assuming that the photosensitive drum 1 is an negative-charged OPC, the first toner is a positive-charged toner and the second toner is a negative-charged toner, an explanation will be given of the operation of the two-color image forming apparatus according to the first embodiment. In FIG. 1, when the photosensitive drum 1 rotates clockwise, the surface of the photosensitive drum 1 is uniformly charged "negative" by the first charger 2. Through exposure by the exposure 3, an electrostatic latent image with three levels of surface potentials of Vca, Vw and Vda is formed on the photosensitive drum 1. The values of the surface potentials are concretely defined, using the symbols in FIG. 2A, as Vca of about −900 V, Vw of about −450 V and Vda of about −50 V. A first toner image positive-charged is developed on the photosensitive drum 1 by the first developing machine 5 to which a developing bias voltage Vb1 (−650 V) has been applied by the power source 15. A second toner image negative-charged is developed on the photosensitive drum 1 by the second developing machine 6 to which a developing bias voltage Vb2 (−250 V) has been applied by the power source 16. The first toners and second toners have been developed using a two-component developer which is a compound of toners and carriers. For both first and second toner images, the developer prevents bead carry-out using ferrite carriers having high resistance of about $10^{10}\Omega\cdot$cm. With the carriers having resistance smaller than $10^{10}\Omega\cdot$cm, carrier application occurs slightly. The carriers, however, can be removed by a carrier recovery magnet so that the secondary problem due to the carrier application does not occur.

The resistance of the carriers can be obtained by multiplying the measured value of the electric resistance of the carriers filled between electrodes apart by a fixed distance by the area of each electrode and dividing it by the distance therebetween. The toner density is 4% by weight. The amount of charged toners is about 10 $\mu$C/g for the first developer and about −6 $\mu$C/g for the second developer.

The two-color toner image composed of the first toner image and second toner image formed on the photosensitive drum 1 by the process described above is corona-irradiated by the second charger 7 to unify the charging polarity into "negative". A high voltage is applied to the second charger 7 from the power source 17. With the applied voltage being positive, the first and second toners are unified into the positive polarity, and with the applied voltage being positive, they are unified into the negative polarity. The polarity of charging depends on that of transfer. In this embodiment, it has been unified into the negative polarity. The toner image is transferred onto a recording medium 12 such as paper and fixed by a fixing machine (not shown). After duplication, the toners remaining on the photosensitive drum 1 are removed by the cleaner 9. Thereafter, the two-color image will be formed again.

In FIG. 1, the exposure control means 4 is a means for defining the white area on the periphery of the charging potential area, which serves to decide whether or not the data to be exposed from image data correspond to the white area and that of the charging potential or discharging potential. If it is decided that they are located on the periphery of the area with the charging potential, they are exposed by a light amount providing a potential between the charging potential and intermediate potential. If it is decided that they are located on the periphery of the area with the discharging potential, they are exposed by a light amount providing a potential between the discharging potential and intermediate potential. Such exposure provides a surface potential distribution on the photosensitive body as shown in FIG. 3A. At the white area on the periphery of the area with the charging potential of Vca, a potential Vdf is formed between the charging potential Vda and intermediate potential Vw. The reverse electric field due to the edge effect on the periphery of each of the image areas which the fringe development occurs, as described above, is attributed to a large difference between the intermediate potential and the potentials of the respective image areas. Therefore, in order to reduce the potential difference, a potential area is formed between the intermediate potential area and the image potential area. Thus, as shown in FIG. 3B, the edge effect can be attenuated to reduce the reverse electric field, thereby providing the fringe development. Hereinafter, the potential (area) newly formed at the white area on the periphery of the image area is referred to as a "correction potential (area)" and the exposure for this purpose is referred to as "correction exposure".

In this embodiment, the light amount by the first correction exposure was adjusted so that the fringe correction potential Vcf on the periphery of the charging potential area is −500 V, and the light amount by the second correction exposure was adjusted so that the fringe correction potential Vdf on the periphery of the discharging potential area is −370 V. The potential difference between the potential on the periphery of the discharging potential area and the intermediate potential (−450 V) is 80 V whereas that between the potential on the periphery of the charging potential area and intermediate potential is 50 V smaller than the above difference 80 V. This is because at the charging potential area, the toners are developed by the first development to reduce the potential difference between the charging potential area and white area so that the edge effect itself can be attenuated to decrease the reduction degree of the potential difference by the correction exposure. The range of the areas on the periphery of the image area which was subjected to the correction exposure was 0.4 mm for the discharging potential area and 0.3 mm for the charging potential area. For the same reason described above, the range of the correction exposure for the charging potential area is more narrow than that for the discharging potential area. Incidentally, with respect to the correction potential and correction range, the large-small relationship between the areas on the peripheries of the charging potential area and discharging potential area may be inverted if the development of the discharging potential area is precedently carried out. This is because the edge effect on the periphery of the image developed precedently is attenuated, as described above. In accordance with the first embodiment, the correction exposure permits the fringe development to be solved and the clear image to be obtained.

Embodiment 2

Light Exposure Control Means

Figure 4:
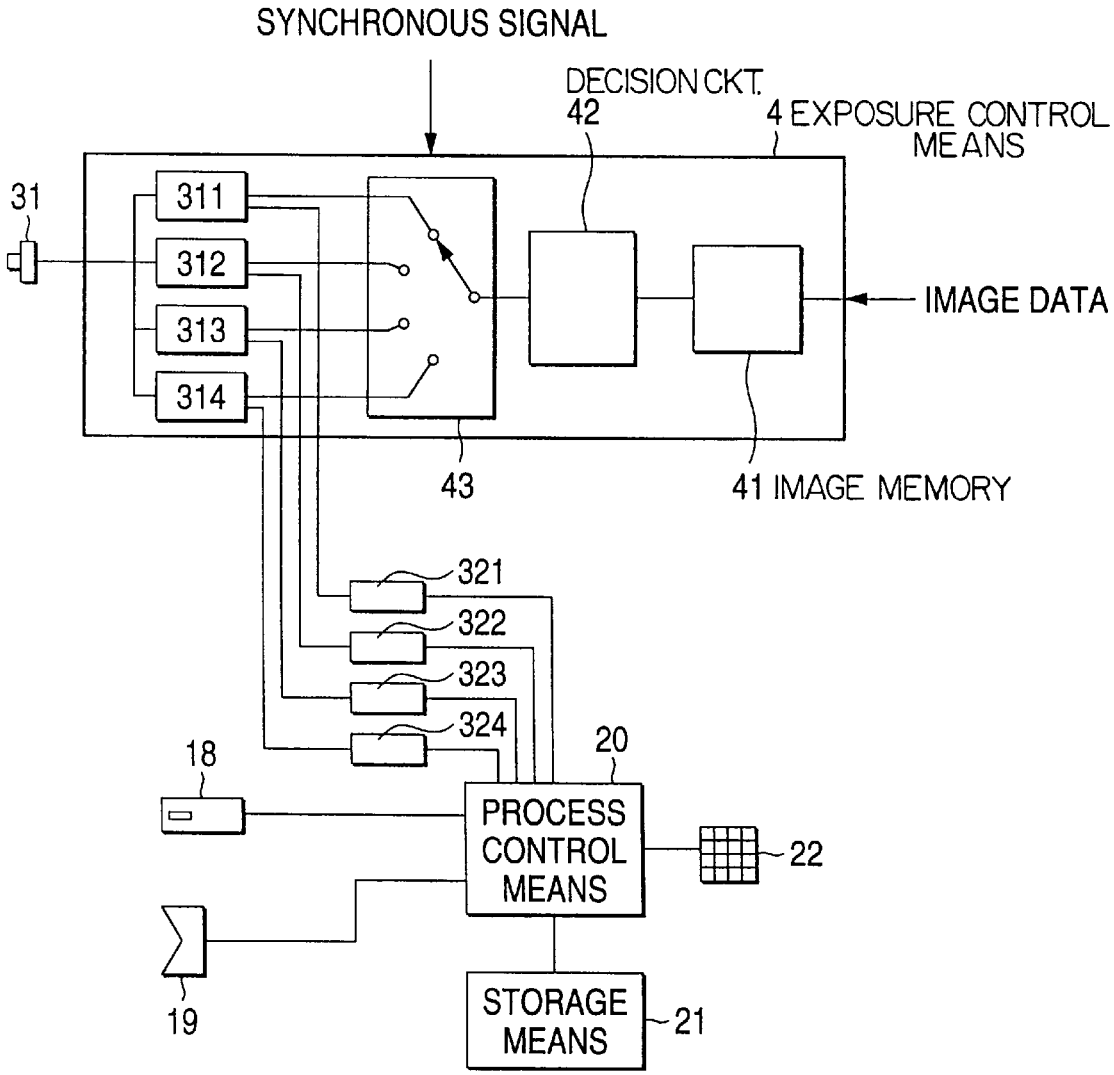
FIG. 4 is a schematic diagram of a correction exposure control unit.

Referring to FIGS. 4 and 5A, 5B, an explanation will be given of a light exposure control means 4 in the two-color image forming apparatus according to the second embodiment of the present invention. FIG. 4 is a schematic diagram of a correction exposure control unit. FIGS. 5A and 5B are views for decision of the correction exposure. Referring to FIG. 4, an explanation will be given of the construction and operation of the correction exposure control unit. FIG. 4 shows the exposure control means 4 and its peripheral circuits. In FIG. 4, reference numeral 4 denotes an exposure control means; 18 a surface potential meter; 19 an toner sensor; 20 a process control means; 21 a storage means; 22 a data inputting means; 31 a laser; 41 an image memory; 42 a decision circuit; 43 a light amount switching circuit; 311, 312, 313, 314 a laser drive circuit, respectively; and 321, 322, 323, 324 a light amount setting means.

The exposure control means 4 mainly includes the image memory 41, decision circuit 42 and light amount switching circuit 43. The decision circuit 42 decides that the area to be now exposed is a charging potential area, a periphery thereof, a discharging potential area, a periphery thereof or a white area apart from both charging area and discharging area on the basis of the data from the image memory 41, i.e. a bit pattern composed of "1"s and "0"s corresponding to the image on the charging potential area and another bit pattern composed of "1"s and "0"s corresponding to the discharging potential. On the basis of the decision result, the light amount is exchanged by the light amount exchanging circuit 43 to expose the photosensitive body.

In FIG. 4, reference numerals 311, 312, 313, 314 denote drive circuits of the laser 31, respectively. Specifically, 311 denotes a drive circuit for producing from the laser the light amount providing the discharging potential area, 312 denotes a drive circuit for producing from the laser the light amount providing the intermediate potential area, 313 denotes a drive circuit from the laser the light amount providing the correction potential Vcf area, and 314 denotes a drive circuit from the laser the light amount providing the correction potential Vdf area. Reference numerals 321, 322, 323, 324 denote the light amount setting means corresponding to the drive circuits 311, 312, 313 and 314. The light amounts are set in terms of digital values. The initial set values may be those stored in the storage means 21 such as an ROM, an IC card memory. The set values can be altered using the data inputting means 22 such as a ten-digit keypad through the process control means 20. The initial set values of digital values are converted into analog outputs by the light amount setting means, and the analog values are used as inputs for light amount setting in the drive circuits. The output light amount can be adjusted by a current using the laser which is a semiconductor laser. Therefore, the analog outputs from the light amount setting means which are current outputs can be used as a laser drive means.

Referring to FIGS. 5A and 5B, concrete examples of decision will be explained. FIG. 5A illustrates the contents of the image memory corresponding to the image on the charging potential area and FIG. 5B illustrates the contents of the image memory corresponding to the image on the discharging potential area. In FIGS. 5A and 5B, the toners are developed on the areas of "1", respectively. The corresponding pixels of "0" in both memories corresponds to the white areas with the toners not developed. The corresponding pixels of "1" in both memories does not occur in the theory in the two-color image forming method. However, if this occurs, one of them is given priority. The pixels in the respective memories cover the size of about 84 $\mu$ square. Now it is assumed that the position of the area to be exposed is (i, j). The symbol i is the position in a main scanning direction of the laser while a polygonal mirror is rotated. The symbol j is the position in a sub-scanning direction of the laser while the photosensitive drum is rotated. At the positions displaced by 1 to 3 pixels from the position (i, j) indicated by a single bold frame at the center, there is an image on the discharging potential area. It was explained in connection with the embodiment of FIG. 1 that the area over 0.4 mm on the periphery of the discharging potential image is subjected to the correction exposure. Therefore, it is decided whether or not the discharging potential area is within the range of 5 pixels from the position (i, j). The decision is made on the basis of such a logic that when the logic sum of the data taken in the ranges from i−5 to i+5 in the main scanning direction and from j−5 to j+5 in the sub-scanning direction is 1, the discharging potential area is within a range of 5 pixels. The logical OR of 121 pixel signals can be taken by 123 OR-circuits which are simply two-input OR circuits. The OR circuits having a larger number of inputs reduces the number of OR circuits to be used. A logic array with a high integration degree can be used. There is no problem in the configuration of the circuit. Next, it is decided that when the logical sum taken for the (i, j) positions on the charging potential image memory and discharging potential image memory is 0, the area at the position at issue is a white area. When it is decided that the discharging potential area is within the range of 5 pixels, the drive circuit is exchanged into the drive circuit 314 for causing the laser to produce the light amount providing the correction potential Vdf area. Thus, light exposure is carried out so that the surface potential at the pixel position of (i, j) is Vdf. The decision described above will be made for each of the pixels so that the five pixels on the periphery of the discharging potential area are placed at the correction potential of the surface potential Vdf. Although not explained, the same decision may be made for the periphery of the charging potential area. If the decision results for the discharging potential area and charging potential area, which may be close to each other, compete each other, e.g. the decision to perform both first correction exposure and second correction exposure in FIGS. 3A and 3B simultaneously is made, one of them is given priority. The priority is given in such a manner that the one nearer to the image area in distance is selected or one having inherently having a large fringe is corrected preferentially. The manner of correcting the potential area having a large fringe preferentially was applied to the embodiment of FIG. 1. This manner, which is simple in logic, could suppress the scale of hardware.

In accordance with the second embodiment described above, the correction exposure can be surely carried out on the decision of the peripheries of the charging potential area and discharging potential area. This solves the fringe development and provides a clear image.

Embodiment 3

Surface Potential Control and Laser Drive Circuit

As the third embodiment of the present invention, referring to FIGS. 2A, 2B and 4, an explanation will be given of an embodiment of the configuration of a laser driving circuit.

In the correction exposure control unit shown in FIG. 4, a system is adopted which properly uses the laser driving circuits for light amounts. The advantage of this system will be explained below. In FIG. 4, reference numeral 18 denotes a surface potential meter. The surface potential meter 18, not shown in FIG. 1, a detector for detecting the surface potential of the photosensitive drum 1. Meanwhile, the two-color image forming apparatus has the charging potential area and discharging area between which the intermediate potential Vw area is sandwiched. The intermediate potential area refers to the white area where the toners are not developed. Now if the intermediate potential changes, "fog" occurs. For example, when Vw is shifted toward the charging area potential Va, the toners to be applied to the charging potential area may be applied the white area. Inversely, when Vw is shifted toward the discharging area potential Vda, the toners to be applied to the discharging potential area may be applied to the white area. The change in the intermediate potential results from the fact that since the property of the photosensitive drum varies with time owing to an environmental change and use for a long time, the surface potential will change even when the laser makes light exposure with the same light amount. Therefore, it is necessary to adjust the light amount of the laser so that the intermediate potential Vw is within a prescribed range of potential values. For this purpose, in this embodiment, the surface potential at the intermediate potential area measured by the surface potential meter 18 is processed by the process control device 20 so as to set the control value in the light amount setting means 322 for the intermediate potential so that the intermediate potential is a prescribed value. Thus, when the laser drive circuit 312 providing the intermediate potential area is driven, the surface potential of the photosensitive drum is maintained at Vw.

There are the following methods for measuring the surface potential at the intermediate potential area.

[Method No. 1]

In this embodiment, the exposure control means 4 for making the correction exposure includes an image memory 41. Therefore, the white area can be recognized from the image memory 41. In order to measure the surface potential, the potential when the surface of the photosensitive body corresponding to the white area reaches the surface potential meter is taken by the process control device 20.

[Method No. 2]

Aside the normal printing operation, the control operation of the intermediate potential will be carried out. In this case, the light exposure providing only the intermediate potential is carried out, and the surface potential is measured at this time. In this method, using cut sheets, the gap between the sheets can be used for controlling the intermediate potential.

In accordance with the third embodiment described above, the light amount for exposure providing the intermediate potential can be adjusted individually from the adjustment of the light amount providing the other potential areas. Therefore, the adjustment is simple and does not affect the other adjustment. Likewise, the light amounts for correction exposure and for exposure of the discharging potential area are also individual from the other adjustment of light amount for exposure so that they are not affected from each other. In the same manner as the adjustment of correction exposure, the light amount is set so as to correspond to the correction potential.

[Embodiment 4]

Correction Potential Control and Laser Drive Circuit

As the fourth embodiment, referring to FIGS. 1 and 4, an explanation will be given of an embodiment of the control condition of the correction exposure.

In connection with the prior art, it was explained that the degree of the fringe development varies in accordance with the developing bias voltage and resistance of the developer. In addition, when the rotating speed of the magnet roller in the developing unit becomes high, scraping force become strong, which results in that the rear end of the normal image becomes faded. Likewise, when the rotating speed of the magnet roller, the degree of the fringe development also varies. For example, the fringe by the toners to be applied to the charging potential area which appears on the periphery of the discharging potential area image has a tendency that at the upper end of the image at the discharging potential area in a direction perpendicular to a travelling direction of the surface of the photosensitive drum, the upper end of the image has less fringe while the rear end of the image has more fringe. This is attributable to the effect of sweeping away and up the toners by the magnetic brush on the magnetic roller. The fringe on the side of the discharging image area in parallel to the travelling direction of the surface of the photosensitive drum is also scraped to have a tendency of becoming less. In accordance with the embodiment described above, when the developing bias, developer resistance and rotating speed of the magnet roller varies, the degree of the fringe development changes so that the correction exposure must be correspondingly adjusted.

The process control means 20 shown in FIGS. 1 and 4 also controls the developing bias voltage and magnet roller rotating speed. Changing the developing bias voltage and magnet roller rotating speed is carried out when the amount of development on the inherent image area varies owing to an environmental change, for example, when the environment becomes a low-temperature low-humidity state so that the amount of development becomes little to reduce the image density. In order to compensate for the reduction in the image density, the developing bias voltage is enhanced or the magnet roller rotating speed is increased. As described above, such a control changes the degree of the fringe development so that as the case may be, the condition of setting the correction exposure must be changed. In this embodiment, in which the laser drive circuit and light amount setting means are individually provided for each of the light amounts, this can be carried out independently of adjustment of the light amount of exposure providing the other potential area as in the case of controlling the intermediate potential in the embodiment described above. Therefore, this can be easily adjusted and does not affect the other operations.

The degree of the fringe development corresponding to the developing bias voltage and magnet roller rotating speed may be previously held in the storage means 21 shown in FIG. 4.

The light amount for the correction exposure corresponding to the developing bias voltage can be adjusted concretely as follows.

When the image density at the charging potential area is reduced, in order to compensate for the reduction in the density by the developing bias voltage, the developing bias voltage Vb1 is adjusted to be lowered so that a difference between the developing bias voltage Vb1 and the charging area potential Vca increases in FIGS. 2A and 2B. Such an adjustment produces the fringe development due to the toners to be developed at the charging potential area on the periphery of the discharging potential area. Therefore, the light amount for exposure due to the second light exposure shown in FIGS. 3A and 3B is increased to lower the potential Vdf at the white area on the periphery of the discharging potential area, thereby preventing the fringe phenomenon. On the other hand, when the image density at the discharging potential area is reduced, in order to compensate for the reduction in the density by the developing bias voltage, the developing bias voltage Vb2 is adjusted to be boosted so that a difference between the developing bias voltage Vb2 and the charging area potential Vda increases in FIGS. 2A and 2B. Such an adjustment produces the fringe development due to the toners to be developed at the discharging potential area on the periphery of the charging potential area. Therefore, the amount of light exposure due to the first light exposure shown in FIGS. 3A and 3B is increased to lower the potential Vcf at the white area on the periphery of the charging potential area, thereby preventing the fringe development.

The light amount for the correction exposure corresponding to the magnet roller rotating speed can be adjusted concretely as follows. When the rotating speed of the magnet roller is increased, the fringe at the upper end of the image area and at the left and right ends of the image in a direction substantially in parallel to the travelling direction of the surface of the photosensitive drum are scraped so that it is likely to decrease. The correction exposure for preventing the fringe is adjusted as follows. The potential Vdf at the white area on the periphery of the discharging potential area is allowed to come near the white area potential Vw by reducing the light amount of exposure in the second correction exposure shown in FIGS. 2A and 2B. The potential Vcf at the white area on the periphery of the charging potential area is allowed to come near the white area potential Vw by increasing the light amount of exposure in the first correction exposure in FIGS. 2A and 2B. On the other hand, the fringe at the rear of the image area is likely to increase as the rotating speed of the magnet roller increases. The light amount for exposure is adjusted as follows. The potential Vdf at the white area on the periphery of the discharging potential area is left a space from the white area potential Vw by increasing the light amount for the second correction exposure shown in FIGS. 3A and 3B. The potential Vcf at the white area on the periphery of the charging potential area is left a space from the white area potential Vw by increasing the light amount for the first correction exposure shown in FIGS. 3A and 3B. As described above, the light amount for the correction exposures corresponding to the rotating speed of the magnet roller is opposite in the direction of adjustment between the upper, right/left ends and the rear end of the image. In this case, the direction of preventing the fringe generated at the rear end of the image area is adjusted.

As described above, since the degree of the fringe development differs at the upper, lower, left and right ends of the image, the range of the correction exposure is preferably judged, in the image memory shown in FIGS. 5A and 5B, not from the image data in the same distance range in the front/rear and left/right directions from the area to be now exposed, but from those in the different ranges in the front/rear and left/right directions. For example, if the moving direction of the surface of the photosensitive body is the same as that of the magnet roll of the developing unit, the fringe development due to the toners applied to the charging potential area on the periphery of the discharging potential image is much at the rear end of the discharging potential image and little at the upper and left/right ends thereof. Therefore, in this case, it is preferred that the range of recognition of data to be subjected to the exposure at j+4 and j+5 in the sub-scanning direction in FIGS. 5A and 5B is narrowed while that already subjected to j−6 and j−7 is widened. Thus, the white area at the lower end of the discharging potential image can be decided as a wider correction exposure range.

In accordance with the forth embodiment described above, even when the developing bias voltage and the rotating speed of the magnet roller are changed, the correction exposure can be surely carried out. Thus, the fringe development can be solved to provide a clear image.

Figure 8:
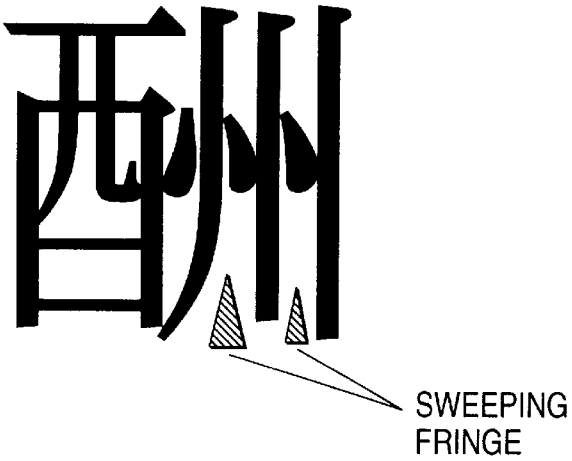
FIG. 8 is a view showing an example of a sweeping fringe.

However, it has been found that the fringe development might occur at the area which cannot be predicted by the analysis of the force applied to the fringe-developed toners. FIG. 8 is a pictorial view of such a fringe development. As a result of careful examination, it has been found that the fringe development occurs at the rear end of a "mouth-opened" image pattern as shown in FIG. 8 under the condition that a relatively much amount of toners is applied to the area at the intermediate potential which is essentially the potential of the photosensitive body as a background area. Thus, it can be admitted that the fringe occurring at the area not predictable is attributable to that the fog toners applied to the white area have been swept by the sliding/contact force by the ears of the developer. The fringe occurring at the area which cannot be predicted by the manner described above is referred to as "sweeping fringe". The method of suppressing the sweeping fringe will be apparent from the graphs shown in FIGS. 9 and 10.

Figure 9:
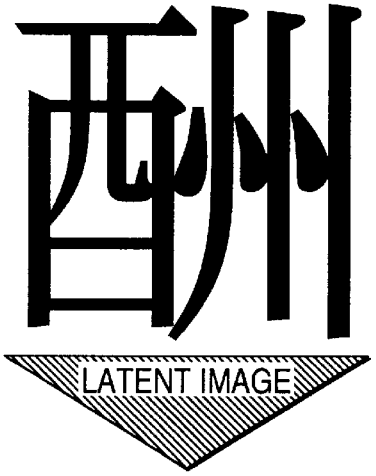
FIG. 9 is a schematic view showing an electrostatic latent image for suppressing the sweeping fringe.

FIG. 9 is a pictorial view of the image in which an electrostatic latent image which is not developed is formed at an area remote from the rear end of the image area.

Figure 10:
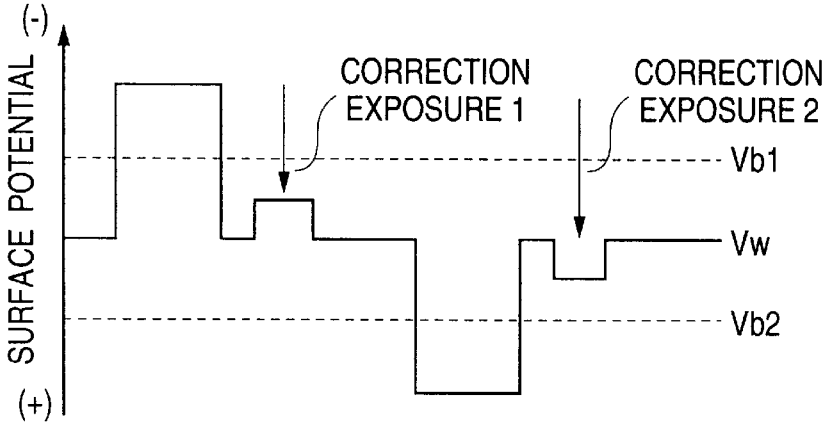
FIG. 10 is a schematic view of correction exposure control means for suppression of the sweeping fringe.

FIG. 10 is a graph showing the potential levels of the electrostatic latent image. As seen from FIG. 10, the correction exposures are carried out in such a fashion that at the rear end of the charging potential area, a potential is placed between the charging potential and intermediate potential while at the rear end of the discharging potential area, another potential is placed between the discharging potential and the intermediate potential.

Embodiment 5

Detection/Control of Fringe Amount

As the fifth embodiment, referring to FIGS. 1 and 4, an explanation will be given of an embodiment of automatically setting the control condition of the correction exposure.

In FIGS. 1 and 4, reference numeral 19 denotes a toner sensor for detecting the amount of toners applied on the photosensitive drum. In this embodiment, a system is adopted in which the toner sensor 19 detects the amount of toners fringe-developed and the condition of correction exposure is set in accordance with the amount of toners. The toner sensor 19 is a semiconductor element composed of a pair of a light emitting diode and photosensitive drum. Light is projected from the light emitting diode onto the photosensitive drum. The light reflected therefrom is detected by the photodiode. If the toners have been applied onto the photosensitive drum, the amount of reflected light is changed with the amount of applied toners. Therefore, the amount of toners applied to the photosensitive drum can be detected.

First, without making the correction exposure, the latent image of either one of the charging potential area and discharging potential area is formed. Now, an explanation will be given of the case where the latent image of the discharging potential area is formed. On the periphery of the latent image of the discharging potential area, the toners serving to develop the charging potential area will be applied. In order to prevent the discharging potential area from being developed, the developing bias voltage is previously switched or the developing unit is stopped in operation. The transfer 8 in FIG. 1 is set in a condition of no transfer. In this way, the amount of fringe toners can be detected by the toner sensor 19.

For the purpose of the correction exposure of the periphery of the charging potential area, the light amount with the surface potential lowered from the intermediate potential Vw at a certain degree is set in the light amount setting means 324. Under this light amount setting condition, the correction exposure is carried out on the periphery of the charging potential area to develop the discharging potential area. The amount of the fringe toners is detected by the toner sensor 19. The amount of the fringe toners-at this time decreases slightly as compared with the case where the correction exposure is not carried out. By carrying out the above operation with different conditions of the correction exposure, a relationship between the light amount setting condition and the amount of fringe toners can be determined. On the basis of this relationship, a suitable light amount condition capable of solving the fringe development can be selected, and the condition thus selected can be set in the light amount setting means as a prescribed value for the correction exposure. Incidentally, the condition for the correction exposure may be set at the time of activating the image forming apparatus or for a predetermined number of printed pages.

Where the amount of the fringe toners is detected for the predetermined number of printed pages, if it has been increased, the light amount of the correction exposure can be adjusted as follows. In the case of the fringe on the charging potential area, the light amount in the first correction exposure in FIGS. 3A and 3B is decreased, while in the case of the fringe on the discharging potential area, that in the second correction exposure in FIGS. 3A and 3B is increased.

In accordance with the fifth embodiment described above, the amount of the fringe toners can be detected to set the corresponding suitable condition of correction exposure automatically, thereby providing a clear image with no fringe for a long time.

Embodiment 6

Measurement/Control of Resistance of Developer

Figure 6:
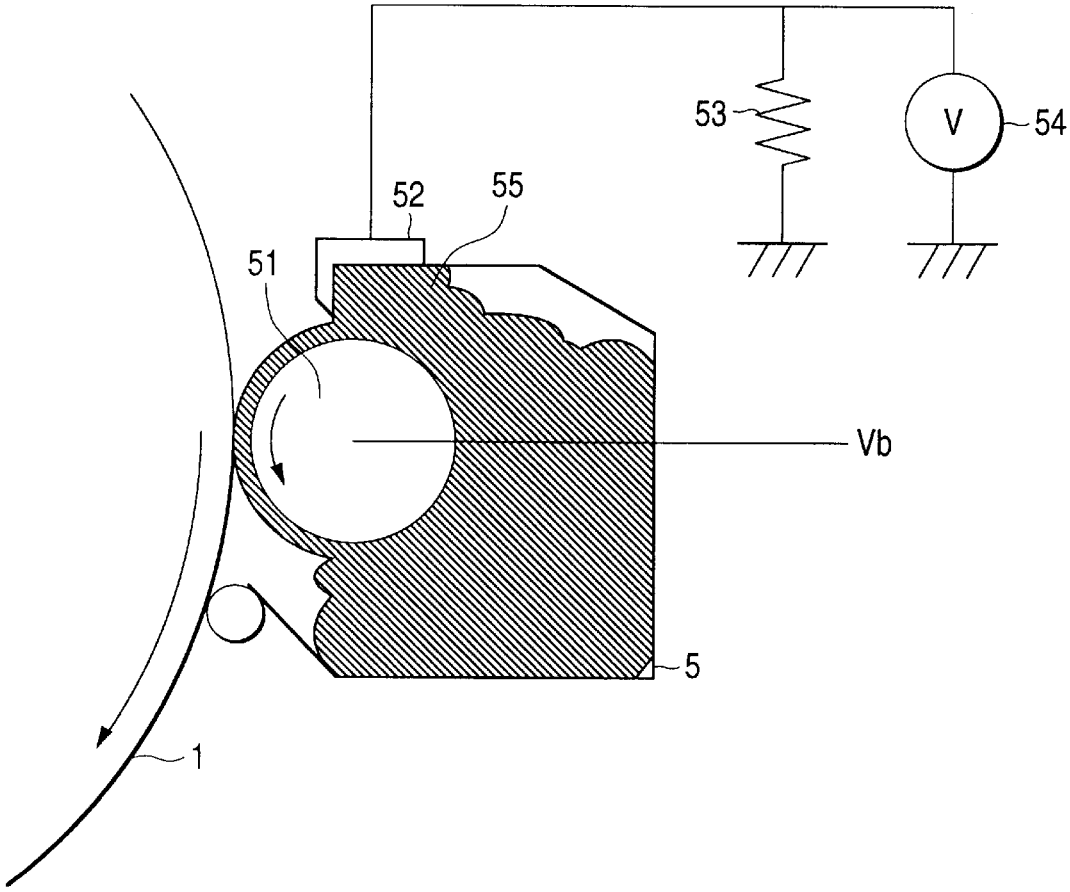
FIG. 6 is a view for explaining a means for measuring resistance of a developer.

As the sixth embodiment, referring to FIGS. 4 and 6, an explanation will be given of the third embodiment of setting the control condition of the correction exposure. FIG. 6 is a view of the means for detecting the resistance of the developer. In FIG. 6, reference numeral 1 denotes a photosensitive drum, 51 a developing roll, 52 a limiting plate, 53 a resistor, 54 a voltmeter, and 55 a developer.

As described in connection with the prior art, a variation in the resistance of the developer gives rise to a change in the fringe development. It has been experimentally confirmed that the resistance of the developer varies because of a change in the toner density, aberration of the carrier surface in the developer due to a long time use, an environmental change, etc. In such a case, in order to solve the fringe development, the resistance of the developer may be a measured to adjust the light amount condition for the correction exposure correspondingly.

FIG. 6 shows a means for measuring the resistance of the developer. The resistance of the developer actually required is that of the developer at the area where the photosensitive drum 1 and the developing roll 51 are opposite to each other. This area may be developed or not developed in accordance with the presence or absence of the electrostatic latent image. Therefore, the current flowing through the developer varies at this area so that the resistance of the developer cannot be precisely measured. For this reason, the resistance is measured between the developing roll 51 and the plate 52 for limiting the film thickness of the developer 55. With the limiting plate 52 made of metal such as aluminum or stainless steel and connected to the resistor 53, the voltage V across the resistor 53 is measured by the voltage meter 54. Assuming that the developing bias voltage applied to the developing roll 51 is Vb, the resistance of the resistor 53 is r, the resistance R of the developer can be approximated to $R=r\times Vb\div V$.

Actually, the voltage is A/D converted and the digital value thus obtained is taken in the process control means 20 in FIG. 4. The arithmetic processing in the process control means provides the resistance of the developer. The prescribed value of the light amount for the correction exposure according to the resistance of the developer is read from the storage means 21 and set in the light amount setting means.

The storage means 21 previously stores the prescribed value causing the light amount of the first correction exposure on the periphery of the charging potential area in FIGS. 3A and 3B and that of the second correction exposure on the periphery of the discharging potential area in FIGS. 3A and 3B when the resistance of the developer increases.

In accordance with the six embodiment thus described, the suitable correction exposure according to the resistance of the developer can be carried out. Therefore, even when the resistance of the developer varies, a clear image with no fringe can be obtained.

Embodiment 7

Another Fashion of Decision of Correction

Figure 7:
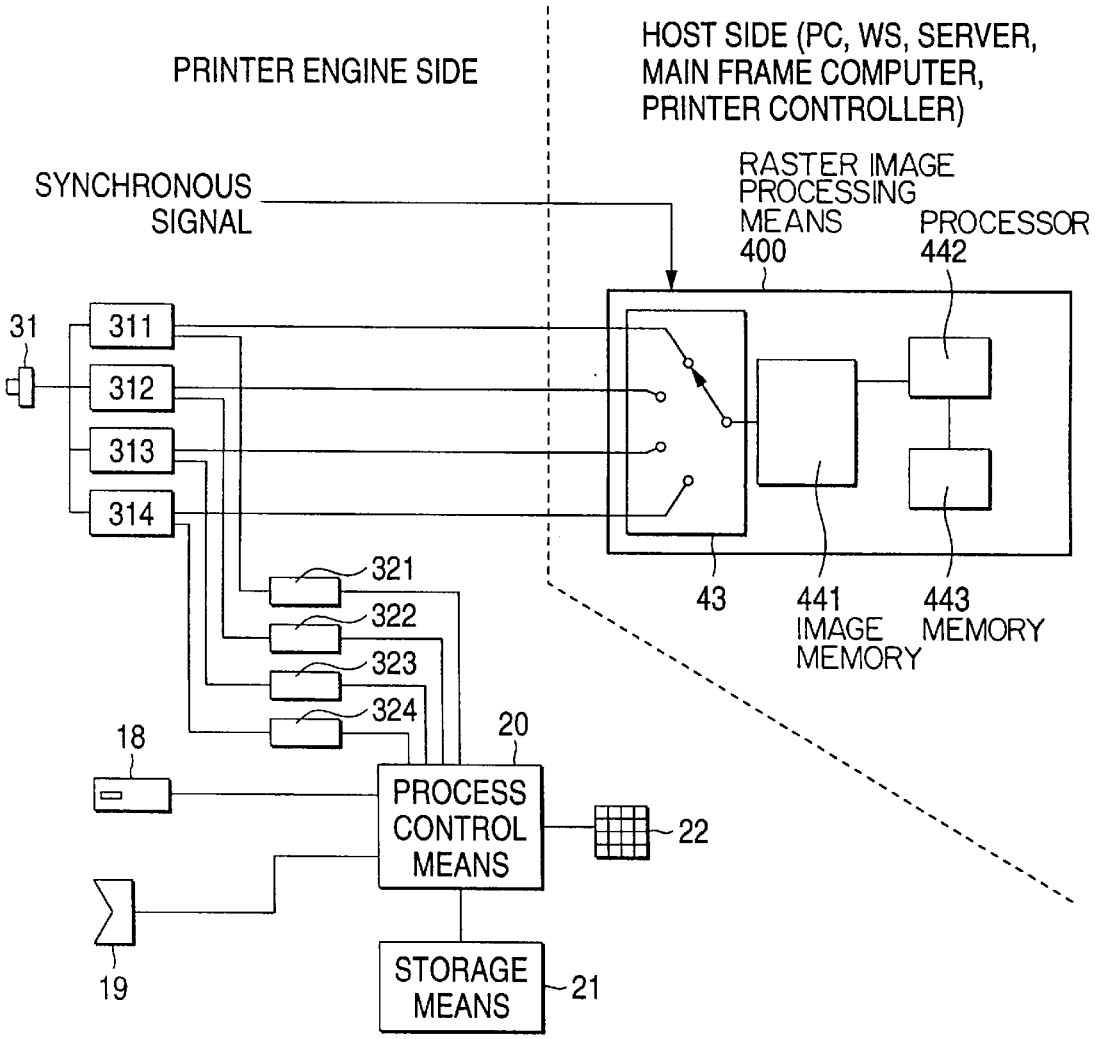
FIG. 7 is a schematic view showing a correction exposure control means in another system.

As the seventh embodiment, referring to FIG. 7, an explanation will be given of another embodiment of the exposure control means 4 in the two-color image forming apparatus according to the present invention. FIG. 7 is a schematic view showing the correction exposure control means in another fashion. In FIG. 7, reference numeral 18 denotes a surface potential meter; 19 a toner sensor; 20 a process control means; 21 a storage means; 22 a data input means; 31 a laser; 43 a light amount switching circuit; 311, 312, 313, 314 a laser drive circuit; 321, 322, 323, 324 a light amount setting means; 400 a raster image processing means; 441 an image memory; 442 a processor; and 443 a memory.

In connection with the correction exposure control unit shown in FIG. 4, it was explained that with the exposure control means 4 provided with the image memory 41, it is decided whether or not the correction exposure should be performed on the basis of the image pattern in the image memory, the decision is made in the decision circuit 42.

Meanwhile, the laser printer prints the image such as a character or picture as a collection of image dots. Particularly, the character, which is normally stored as a symbol (character code) in the text to be printed, is developed as a collection of dots and is first placed in a printable state. Such development processing is referred to as "raster image processing". When viewed from the side of a printer engine for forming an image, this development processing is carried out on the side of the host (image data creating device) such as the "controller" provided within the printer body, a computer connected to the printer, etc. The raster image processing converts the character code or graphic into pixel data of a collection of dots. The pixel data after the development processing are transferred to the printer so that the light emission of the laser is controlled in accordance with the I/O of the pixel data.

In this case, since the correction exposure controls the light amount of the laser, a system for creating the decision data for the control in software is now proposed. FIG. 7 is a schematic diagram of such a correction exposure control system. In FIG. 7, reference numeral 400 denotes a raster image processing means including the function of the fringe correction control. The raster image processing means 400 includes a processor 442, a memory 443 storing a raster image processing program and fringe correction program, and an image memory 441 storing the pixel data after the raster image processing. The raster image processing means 400 also includes a light amount switching circuit 43 for exposure with different light amounts inclusive of the fringe correction exposure, which has substantially the same structure as the light amount switching circuit shown in FIG. 4.

In this system, the raster image processing is carried out, and thereafter the decision processing for the fringe correction exposure is carried out. The image memory 441 stores the fringe correction data as well as the inherent pixel data. Upon completion of the processing for a single page to be printed, in synchronism with the synchronizing signal from the printer side, e.g. a page starting signal and a BD signal for synchronization with the rotation of the polygon mirror in the page.

The seventh embodiment described above, in which the decision relative to the fringe correction exposure is carried out in software, is flexibly compatible with several conditions as compared with the case where the decision is made in hardware. For example, where the charging potential area and the discharging area are close to each other, the control can be flexibly made for changing the correction in accordance with the distance from these areas or correction range in the vertical and horizontal directions of the image.

Embodiment 8

In the developing unit as described above, a ferrite carrier having a resistance of $10^{10}\Omega\cdot$cm was used. It was explained that the carrier having resistance smaller than $10^{10}\Omega\cdot$cm is applied to the photosensitive drum, it can be removed by a carrier recovery magnet.

Meanwhile, the resistance of the two-component developer represents that in a state where toners and carriers are mixed. The toners, made of resin, can be substantially regarded as an insulator as compared with the carriers. Therefore, if the carrier with low resistance is used, because of the toners present between the carriers, the resistance of the developer does not decrease with that of the carrier. Actually, it was found that the developers when the carriers having resistance of a difference of seven order of magnitude ($10^{10}\Omega\cdot$cm and $10^{3}\Omega\cdot$cm) are mixed with the same toners provide a difference of resistance of only one-order of magnitude therebetween. It should be noted that the resistance of the carrier can be adjusted by the amount of the magnetic material used for the carrier such as ferrite or iron powder, resin to be coated to the carrier surface, or conductive material to be mixed with the resin.

It was experimentally confirmed that when the carrier has a remarkably low resistance lower than $10^{3}\Omega\cdot$cm, the resultant developer has too lower resistance. Namely, when the developer having such low resistance is used, the amount of carriers applied onto the photosensitive drum increases so that the carriers could not be completely recovered by the carrier recovery magnet. This gave rise to a problem that poor duplication of the toner image from the photosensitive body to a sheet of paper so that the character or image drops partially.

In order to overcome such a problem, it was found that the carrier having resistance not smaller than $10^{3}\Omega\cdot$cm is preferably used. When the two-component developer having such carriers and toners, the resistance thereof is not so low as a developer, and its application can be suppressed to the degree enough to be removed by the carrier recovery magnet. The fringe development due to the resistance of the developer being not low can be solved by the correction exposure.

As described above, the present invention can provide a two-color image forming apparatus which can prevent a clear image free from fringe development.

What is claimed is:

1. A two-color image forming apparatus comprising:

a charged photosensitive body exposed with different light amounts for exposure by an exposure means to create electrostatic latent images at three-level potential areas composed of a charging potential area, discharging potential area and an intermediate potential therebetween; and positive-charged toners and negative-charged toners developed at the potential areas other than the intermediate potential area to form a two-color toner image on the photosensitive body, wherein the intermediate potential area at the rear end of an image area in a rotating direction of a developing roll and apart from the image area is exposed with light amount providing a potential between a charging potential or discharging potential and an intermediate potential.

2. An image data creating device for a two-color image forming apparatus in which a charged photosensitive body is exposed with different amounts of light for exposure to create electrostatic latent images at three-level potential areas composed of a charging potential area, discharging potential area and an intermediate potential therebetween, and positive-charged toners and negative-charged toners are developed at the potential areas other than the intermediate potential area to form a two-color toner image on the photosensitive body, comprising:

a raster image processing means for developing an image into a collection of dots and deciding the white area on the periphery of each of the potential areas with the toners charged.

3. A two-color image forming apparatus in which a charged photosensitive body is exposed with different light amounts for exposure to create electrostatic latent images at three-level potential areas composed of a charging potential area, discharging potential area and an intermediate potential therebetween, and the electrostatic latent image is developed using positive-charged toners and negative-charged toners are developed at the potential areas other than the intermediate potential area to form a two-color toner image on the photosensitive body, and in which an exposure means is provided for exposing the photosensitive body to light amounts providing the three-level potential areas and also white areas on the periphery of the potential areas with the toners developed to light amounts providing potentials between the potentials with the toners developed and the intermediate potential, comprising:

means for deciding presence or absence of a charging potential area and discharging potential area of each of the white areas;

means for exposing the white area to a light amount providing a potential between the charging potential or discharging potential and the intermediate potential;

circuits for driving said exposure means corresponding to light amounts for exposure;

means for setting said light amounts for exposure; and means for measuring a surface potential of said photosensitive body, wherein the light amounts are set in said light amount setting means on the basis of the potentials measured by said surface potential measuring means, and light amount for correction exposure is also set.

4. A two-color image forming apparatus in which a charged photosensitive body is exposed with different light amounts for exposure to create electrostatic latent images at three-level potential areas composed of a charging potential area, discharging potential area and an intermediate potential therebetween, and the electrostatic latent image is developed using positive-charged toners and negative-charged toners are developed at the potential areas other than the intermediate potential area to form a two-color toner image on the photosensitive body, and in which an exposure means is provided for exposing the photosensitive body to light amounts providing the three-level potential areas and also white areas on the periphery of the potential areas with the toners developed to light amounts providing potentials between the potentials with the toners developed and the intermediate potential, comprising:

means for deciding presence or absence of a charging potential area and discharging potential area of each of the white areas; and means for exposing the white area to a light amount providing a potential between the charging potential or discharging potential and the intermediate potential, wherein the light amount for exposing each of the white areas on the periphery of the potential areas with the toners developed is changed in accordance with a developing bias voltage and a rotating speed of a developing roll in a developing unit.

5. A two-color image forming apparatus in which a charged photosensitive body is exposed with different light amounts for exposure to create electrostatic latent images at three-level potential areas composed of a charging potential area, discharging potential area and an intermediate potential therebetween, and the electrostatic latent image is developed using positive-charged toners and negative-charged toners are developed at the potential areas other than the intermediate potential area to form a two-color toner image on the photosensitive body, and in which an exposure means is provided for exposing the photosensitive body to light amounts providing the three-level potential areas and also white areas on the periphery of the potential areas with the toners developed to light amounts providing potentials between the potentials with the toners developed and the intermediate potential, comprising:

means for deciding presence or absence of a charging potential area and discharging potential area of each of the white areas;

means for exposing the white area to a light amount providing a potential between the charging potential or discharging potential and the intermediate potential; and a toner sensor for detecting amount of toners applied to the white areas on the periphery of the potential areas other than the intermediate potential area, in which the light amounts for exposure providing the white areas on the periphery of the potential areas other than the intermediate potential are changed in accordance with the detected amount of toners by said toner sensor.

6. A two-color image forming apparatus according to claim 5, wherein the light amount for exposure providing the potential at the white area on the periphery of each of the potential areas other than the intermediate potential area is adjusted so as to decrease the amount of toners detected by said toner sensor.

7. A two-color image forming apparatus in which a charged photosensitive body is exposed with different light amounts for exposure to create electrostatic latent images at three-level potential areas composed of a charging potential area, discharging potential area and an intermediate potential therebetween, and the electrostatic latent image is developed using positive-charged toners and negative-charged toners are developed at the potential areas other than the intermediate potential area to form a two-color toner image on the photosensitive body, and in which an exposure means is provided for exposing the photosensitive body to light amounts providing the three-level potential areas and also white areas on the periphery of the potential areas with the toners developed to light amounts providing potentials between the potentials with the toners developed and the intermediate potential, comprising:

means for deciding presence or absence of a charging potential area and discharging potential area of each of the white areas; and means for exposing the white area to a light amount providing a potential between the charging potential or discharging potential and the intermediate potential, wherein the light amount for exposure to the white area on the periphery of each of the potential areas with the toners developed is changed in accordance with the resistance of a developer.

8. A two-color image forming apparatus in which a charged photosensitive body is exposed with different light amounts for exposure to create electrostatic latent images at three-level potential areas composed of a charging potential area, discharging potential area and an intermediate potential therebetween, and the electrostatic latent image is developed using positive-charged toners and negative-charged toners are developed at the potential areas other than the intermediate potential area to form a two-color toner image on the photosensitive body, and in which an exposure means is provided for exposing the photosensitive body to light amounts providing the three-level potential areas and also white areas on the periphery of the potential areas with the toners developed to light amounts providing potentials between the potentials with the toners developed and the intermediate potential, comprising:

means for deciding presence or absence of a charging potential area and discharging potential area of each of the white areas;

means for exposing the white area to a light amount providing a potential between the charging potential or discharging potential and the intermediate potential; and an image memory and an arithmetic processor in which said arithmetic processor performs raster image processing of developing an image into a collection of dots and decides the white area on the periphery of each of the potential areas with the toners developed.

9. A two-color image forming apparatus according to any one of claims 2–8, wherein the electrostatic latent images are developed using a two-component developer composed of carriers having resistance not smaller than $10^3 \Omega \cdot cm$ and toners.

* * * * *